US010793323B2

(12) United States Patent
Cosman

(10) Patent No.: US 10,793,323 B2
(45) **Date of Patent: *Oct. 6, 2020**

(54) CONTAINER WITH TAPERED CONNECTOR

(71) Applicant: Weiler Engineering, Inc., Elgin, IL (US)

(72) Inventor: Valentin Cosman, Barrington Hills, IL (US)

(73) Assignee: Weiler Engineering, Inc., Elgin, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/525,146

(22) Filed: Jul. 29, 2019

(65) Prior Publication Data

US 2019/0344932 A1 Nov. 14, 2019

Related U.S. Application Data

(63) Continuation-in-part of application No. 14/596,550, filed on Jan. 14, 2015, now Pat. No. 10,363,369.

(51) Int. Cl.
*B65D 1/09* (2006.01)
*B65D 1/02* (2006.01)
*B65D 39/00* (2006.01)

(52) U.S. Cl.
CPC ..... *B65D 39/0076* (2013.01); *B65D 1/0223* (2013.01); *B65D 1/09* (2013.01); *B65D 2251/205* (2013.01)

(58) Field of Classification Search
CPC ..... A61M 5/28; A61M 5/288; A61M 5/285
USPC ..... 53/452; 215/45
See application file for complete search history.

(56) References Cited

U.S. PATENT DOCUMENTS 6,068,148 A * 5/2000 Weiler ..... A61J 1/067 141/346
7,040,497 B2 * 5/2006 Weiler ..... B65D 1/095 215/204
2003/0146245 A1 * 8/2003 Weiler ..... B65D 1/0238 222/420

* cited by examiner

*Primary Examiner* — Anthony D Stashick
*Assistant Examiner* — Raven Collins
(74) *Attorney, Agent, or Firm* — Olson & Cepuritis, Ltd.

(57) ABSTRACT

A hermetically sealed thermoplastic container or ampoule having a hollow body portion, a neck portion, unitary with the body portion and terminating in a circumferential, inwardly extending sealing flange, and a removable cap. The neck portion defines an access passageway to the hollow body portion a portion of which is configured as a tapered female connector adapted to receive a tapered male connector when the access passageway is open. The outer surface of the neck portion can be provided with lugs for engaging a tapered male connector with a threaded collar.

14 Claims, 2 Drawing Sheets

CONTAINER WITH TAPERED CONNECTOR

CROSS-REFERENCE TO RELATED APPLICATION

This application is a continuation-in-part of U.S. patent application Ser. No. 14/596,550, filed on Jan. 14, 2015, which is incorporated herein by reference in its entirety.

FIELD OF INVENTION

This invention relates to a hermetically sealed thermoplastic container or ampoule with tapered connector.

BACKGROUND OF THE INVENTION

Hermetically sealed containers manufactured by the so-called blow-fill-seal method have enjoyed widespread acceptance for dispensing liquid medicaments and the like.

Tapered connectors or fittings are used for making leak-free connections between a male-taper fitting and its mating female part on various containers for medications, medical and laboratory instruments, including hypodermic syringe tips and needles, and the like. There are two varieties of taper connectors: lock connectors and slip connectors. Lock connectors have tapered male and female fittings securely joined to one another by means of a tabbed hub on the female fitting which screws into internal threads in a collar or sleeve on the male fitting. Slip connectors, sometimes referred to as slip tip fittings, are pressed together and held to one another by friction.

It would be desirable to provide a hermetically sealed thermoplastic container or ampoule with an easily removable cap or closure and with an access passageway sized to receive a variety of implements with tapered connectors, such as those described in International Standard ISO 80369. The present invention provides such a container.

SUMMARY OF THE INVENTION

A hermetically sealed container or ampoule is made of a thermoplastic material, such as a polyolefin, and the like, and is provided with a readily removable cap which occludes an access passageway defined by a neck portion of the container. The access passageway may be aligned with the longitudinal axis of the container or ampoule.

A hermetically sealed container embodying the present invention has a hollow body portion that defines a predetermined volume, and a neck portion that is unitary with the body portion and defines an access passageway surrounded by an inwardly extending sealing flange. A removable cap occludes the access passageway. When the cap is removed, the access passageway terminates in an opening surrounded by an inwardly extending circumferential sealing flange and allows access to the container contents.

Part of the neck portion is tapered and configured as a tapered female connector or fitting adapted to receive a tapered male connector or fitting when the access passageway is open. The neck portion around its periphery may include external lugs for engaging a collar or sleeve of a tapered male connector or fitting. The lugs also contribute to rigidity and dimensional stability of the access passageway aperture.

A container or ampoule embodying the present invention comprises a hermetically sealed container of a thermoplastic material having a hollow body portion, a neck portion unitary with the body portion and which terminates in a circumferential, inwardly extending sealing flange which defines an aperture or opening sized to receive a tapered male connector. A removable cap is joined to the sealing flange by a frangible web unitary with the removable cap and with the sealing flange. The neck portion of the container defines an access passageway to the hollow body portion. The passageway includes an antechamber adjacent to a throat region configured as a tapered female connector sized to receive a tapered male connector when the cap is removed and the access passageway is open. The antechamber can have a conical or a cylindrical configuration.

The hermetically sealed container may be provided with a plurality of lugs, preferably a pair of opposed external lugs, on the neck portion. The lugs are situated below the sealing flange, i.e., axially spaced from the sealing flange. The sealing flange preferably has a quadrilateral cross-section or a trapezoid cross-section.

In a hermetically sealed container having a sealing flange with a trapezoid cross-section, the trapezoid has a proximal base adjacent to the neck portion and an opposed distal base that is shorter than the proximal base. Preferably, the proximal base of the trapezoid is at least two times longer than the distal base of the trapezoid. The distal base of the trapezoid may or may not overlap the proximal base of the trapezoid.

A removable cap, unitary with the dispensing nozzle occludes the dispensing nozzle and the access passageway. The removable cap is connected at its rim to the dispensing nozzle by a frangible web that is unitary with the cap as well as with the sealing flange that surrounds the access passageway.

The removable cap has an elongated tab or trigger that is unitary with the cap and extends across at least a major part of the top surface of the cap. The tab is positioned across the top surface of the removable cap for engagement therewith when the tab or trigger is manipulated either in a twisting motion or generally about the longitudinal axis of the nozzle. Manipulation of the tab severs the frangible web and permits removal of the cap to gain access to the container or ampoule contents.

DETAILED DESCRIPTION OF THE PREFERRED EMBODIMENTS

Figure 1:
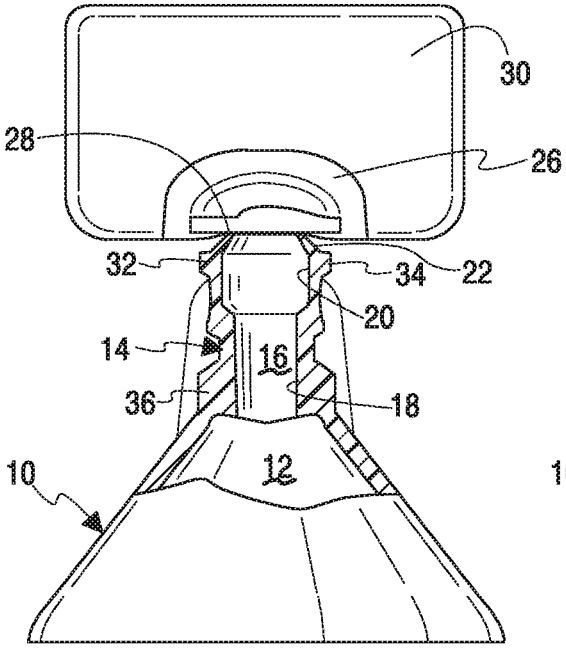
FIG. 1 is a fragmentary front elevational view, partly in section, showing a hermetically sealed container embodying the present invention with a removable cap in place.
Figure 2:
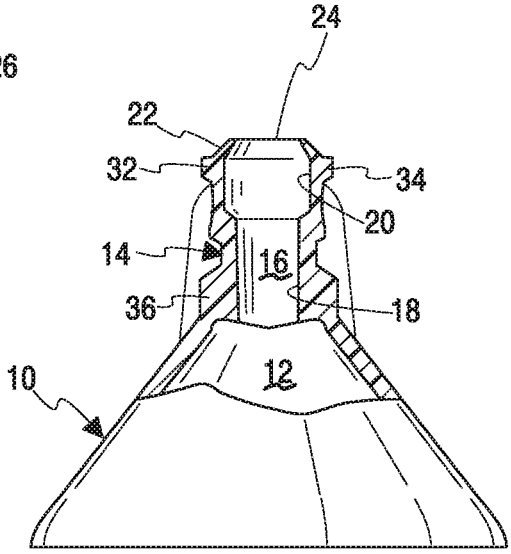
FIG. 2 shows the container of FIG. 1 without the removable cap.

Referring to the drawings, FIGS. 1 and 2 show a hermetically sealed container 10 made of a thermoplastic material. Container 10 has a hollow body portion 12 and a neck portion 14 unitary with body portion 12. Neck portion 14 defines access passageway 16 which has a tapered throat region 18 and antechamber 20 adjacent to the tapered throat region. Access passageway 16 terminates in a circumferential, inwardly extending flange 22 which, in turn, defines an opening 24 sized to receive the tip of a tapered male connector. Removable cap 26, when in place, occludes opening 24 and is connected to flange 22 by a unitary frangible web 28. Removable cap 26 is provided with optional tab 30 which is unitary with cap 26. Manipulation of tab 30 severs frangible web 28 and provides access to passageway 16 as will be discussed in greater detail below. Optional opposed external lugs 32, 34 are provided on neck portion 14, axially spaced from flange 22, and sized to engage internal threads of a collar that surrounds a tapered tip in a tapered male connector. Opposed lugs 32, 34 extend outwardly from neck portion 14 below inwardly extending flange 22. A thickened region of neck portion 14 at the juncture thereof with hollow body portion 12 defines a circumferential boss 36 sized for engagement with a collar that surrounds a tapered male connector.

The taper angle on the tapered throat region 18 can vary to match the taper angle of a tapered male connector to be connected thereto. The taper angle usually is in the range of about 5 degrees to about 6 degrees so as to comply with International Standard ISO 80369-6 for small bore connectors for liquids and gases in healthcare applications.

Figure 3:
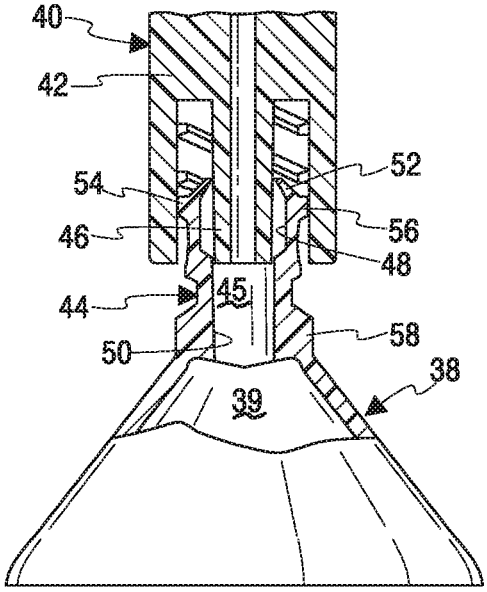
FIG. 3 is a fragmentary front elevational view, partly in section, showing a tapered male connector partially received in a tapered female connector of a container embodying the present invention and having a neck portion provided with external lugs.
Figure 4:
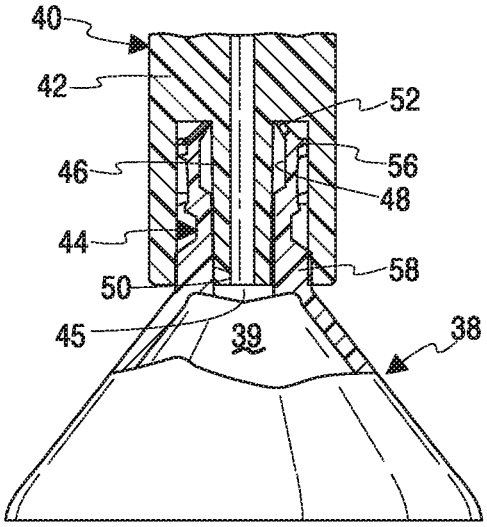
FIG. 4 shows the container of FIG. 3 with the tapered male connector connected to the tapered female connector.

FIG. 3 shows a small bore tapered male connector 40 on container 38 embodying the present invention. Neck portion 44 of container 38 defines access passageway 45 having conical antechamber 48, tapered throat region 50 between antechamber 48 and hollow body portion 39. Access passageway 45 terminates in inwardly extending circumferential flange 52 which is unitary with neck portion 44. Opposed external lugs 54, 56 are provided below circumferential flange 52. Distal end portion of neck portion has a relatively thicken wall at the juncture with hollow body portion 39 and defines boss 58. As tapered male connector 40 is threaded onto lugs 54, 56, tip 46 passes through conical antechamber 48 and enters tapered throat region 50 of neck portion 44, inwardly extending circumferential flange 52 slides along the tapered portion of a male connector and is urged against the distal end portion of the tapered portion of the male connector as shown in FIG. 4, thereby providing a secondary seal for the tapered male connector 40 when the tapered portion or tip thereof is seated in tapered throat region 50. At the same time threaded collar 42 engages boss 58 further stabilizing the connection.

Figure 5:
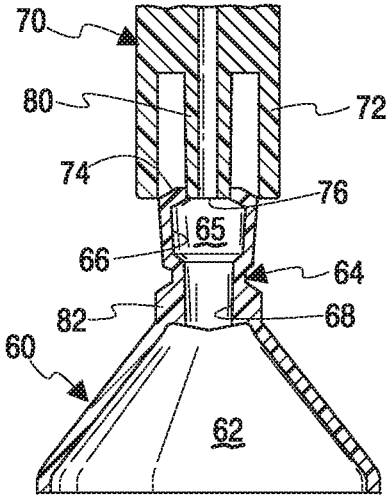
FIG. 5 is a fragmentary front elevational view, partly in section, showing a tapered male connector partially received in a container neck portion without external lugs.
Figure 6:
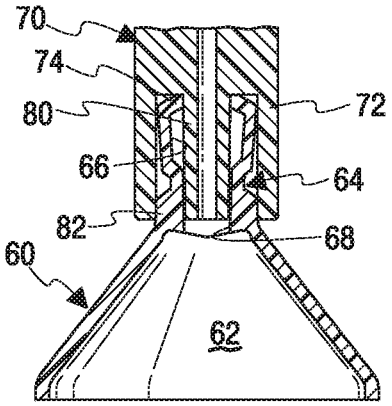
FIG. 6 shows the container of FIG. 5 with the tapered male connector received in the tapered female connector in the container neck portion.

FIGS. 5 and 6 show thermoplastic container 60 having hollow body portion 62 and neck portion 64 unitary therewith. Neck portion 64 does not have external lugs, instead collar 72 of tapered male connector 70 is slidably received over neck portion 64 which defines conical antechamber 66 and tapered throat region 68 in access passageway 65. Inwardly extending circumferential flange 74 defines opening 76 for receiving tapered tip 80 of tapered male connector 70. Tapered throat region 68 serves as a tapered female connector for tapered male connector 70.

A completed connection is shown in FIG. 6. Collar 72 is engaged by boss 82 on neck portion 64, and inwardly extending flange 74 sealingly engages distal end of tip 80.

FIGS. 7-10 illustrate another embodiment of the present invention where the inwardly extending flange extends into the access passageway at an angle of about 90 degrees relative to the inner wall of the container neck portion instead of forming an obtuse angle as shown in FIGS. 3-6.

Figure 7:
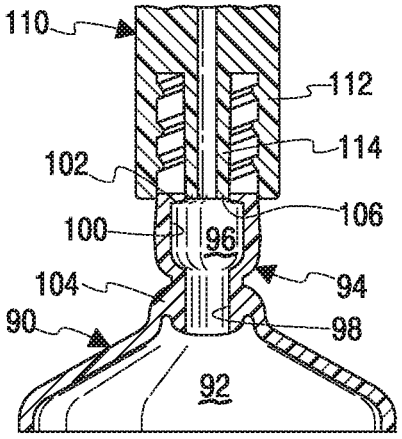
FIG. 7 is a fragmentary front elevational view, partly in section, showing a container and a tapered male connector having a threaded collar partially received in the container neck portion that has no external lugs.

Referring to FIG. 7, thermoplastic container 90 has a hollow body portion 92 and unitary neck portion 94 which defines access passageway 96. Neck portion 94 also defines tapered throat region 98 adjacent to hollow body portion 92 and terminates in an inwardly extending circumferential flange 102 which extends into access passageway 96 at an angle of about 90 degrees relative to the inner wall of neck portion 94. Flange 102 defines opening or aperture 106 sized to receive the tapered tip of the tapered male connector. Neck portion 94 also defines a conical antechamber 100 between tapered throat region 98 and flange 102. Boss 104 is situated at the juncture of hollow body portion 92 and unitary neck portion 94.

Figure 8:
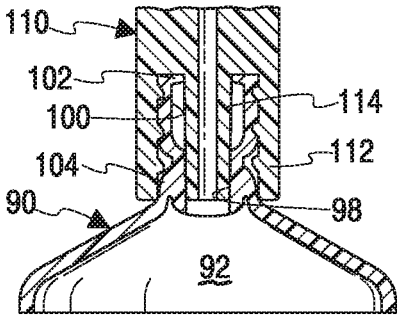
FIG. 8 shows the container of FIG. 7 with the tapered male connector received in the female connector in the container neck portion.

Tapered male connector 110 with an internally threaded collar 112 is shown in FIG. 7 at opening or aperture 106 defined by flange 102. As tapered male connector is threaded onto neck portion 94, flange 102 slides along tip 114 until tip 114 engages tapered throat region 98, thereby sealing the container. Flange 102 is compressed against the distal end portion of tip 114 providing a secondary seal for the container as shown in FIG. 8.

When the thermoplastic material of the construction of container is relatively softer than the material of construction for the tapered male connector, the antechamber in the neck portion of the container provides additional flexibility that facilitates threading of the tapered male connector onto the neck portion without requiring external lug's on the neck portion.

Figure 9:
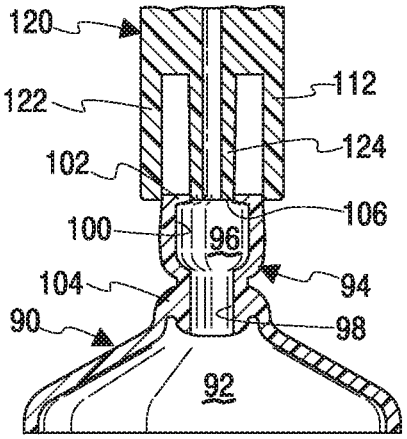
FIG. 9 is a fragmentary front elevational view, partly in section, showing a container embodiment and a tapered male connector having an unthreaded collar partially received in the container neck portion.
Figure 10:
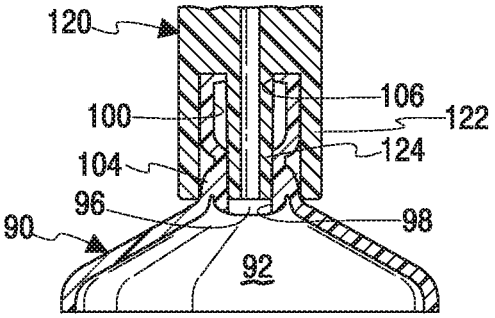
FIG. 10 shows the container of FIG. 9 with tapered male connector received in the female connector in the container neck portion.

FIGS. 9 and 10 show container 90 with tapered male connector 120 having a collar 122 without internal threads. Tip 124 of tapered male connector passes through opening 106 defined by flange 102 and is slidably received within tapered throat region 98 while collar 120 engaged boss 104. At the same time flange 102 is urged against the distal end portion of tip 124 and provides a secondary seal for the container.

In the embodiments shown in FIGS. 1-6, the sealing flange extends inwardly at an obtuse angle, preferably at an angle in the range of about 120 degrees to about 150 degrees. A flange having a trapezoid cross-section is illustrated in FIGS. 1-4, a flange having a quadrilateral cross-section is illustrated in FIGS. 5 and 6.

The procedure for forming, filling and sealing of thermoplastic, hermetically sealed containers is well known in the art and is generally described in U.S. Pat. No. 3,597,793 to Weiler et al. Containers embodying the present invention can be formed, filled, and sealed under sterile or aseptic conditions using techniques known in the art as described in U.S. Pat. No. 4,178,976 to Weiler et al. Suitable thermoplastic polyolefin materials of construction are polypropylene (PP), high density polyethylene (HDPE), low density polyethylene (LDPE), and the like. A particularly preferred material of construction is polypropylene.

The foregoing description and the drawings are illustrative of the invention, but are not to be taken as limiting. Still other variants within the spirit and scope of this invention are possible and will readily present themselves to those skilled in the art.

The invention claimed is:

1. A hermetically sealed container of a thermoplastic material and comprising a hollow body portion, a neck portion unitary with the body portion and terminating in a circumferential, inwardly extending sealing flange which defines an opening sized to receive a tapered male connector, and a removable cap joined to the sealing flange by a frangible web unitary with the removable cap and with the sealing flange;

the neck portion defining an access passageway to the hollow body portion, the access passageway including an antechamber and a throat region configured as a tapered female connector sized to receive a tapered male connector, and a pair of opposed lugs on the neck portion below the sealing flange.

2. The hermetically sealed container in accordance with claim 1 wherein the antechamber has a conical configuration.

3. The hermetically sealed container in accordance with claim 1 wherein the antechamber has a cylindrical configuration.

4. The hermetically sealed container in accordance with claim 1 wherein the sealing flange is at an acute angle relative to a longitudinal axis of the access passageway.

5. The hermetically sealed container in accordance with claim 1 wherein the sealing flange is at about 90 degrees relative to a longitudinal axis of the access passageway.

6. The hermetically sealed container in accordance with claim 1 wherein distal end portion of the neck portion is sized to receive a collar of the tapered male connector.

7. The hermetically sealed container in accordance with claim 1 wherein said throat region is axially spaced from the opposed external lugs.

8. The hermetically sealed container in accordance with claim 1 wherein said sealing flange has a quadrilateral cross-section.

9. The hermetically sealed container in accordance with claim 1 wherein said sealing flange has a trapezoid cross-section.

10. The hermetically sealed container in accordance with claim 9 wherein said trapezoid has a proximal base adjacent to the neck portion and an opposed distal base.

11. The hermetically sealed container in accordance with claim 10 wherein the proximal base of the trapezoid is approximately two times longer than the distal base of the trapezoid.

12. The hermetically sealed container in accordance with claim 9 wherein the distal base of the trapezoid does not overlap the proximal base of the trapezoid.

13. The hermetically sealed container in accordance with claim 1 further provided with a tab unitary on the removable cap.

14. The hermetically sealed container in accordance with claim 1 wherein the neck portion defines a circumferential boss at the juncture thereof with the hollow body portion.

* * * * *